US006971605B1

(12) United States Patent
Martin

(10) Patent No.: US 6,971,605 B1
(45) Date of Patent: Dec. 6, 2005

(54) DEVICE FOR WINDING / TAKING UP CABLES, RIBBONS, OR OTHER COILABLE STRUCTURES

(76) Inventor: Jay K. Martin, 1701 Camelot Dr., Madison, WI (US) 53705

( * ) Notice: Subject to any disclaimer, the term of this patent is extended or adjusted under 35 U.S.C. 154(b) by 161 days.

(21) Appl. No.: 10/719,166

(22) Filed: Nov. 21, 2003

Related U.S. Application Data

(60) Provisional application No. 60/429,186, filed on Nov. 26, 2002.

(51) Int. Cl.[7] ..... B65H 75/40
(52) U.S. Cl. ..... 242/386; 242/397.3; 242/405.3
(58) Field of Search ..... 242/386, 397.3, 242/405.3, 128, 241

(56) References Cited

U.S. PATENT DOCUMENTS

| | | | | |
|---|---|---|---|---|
| 2,274,330 A | | 2/1942 | Hammond | |
| 3,025,019 A | * | 3/1962 | Aschinger | 242/386 |
| 3,202,372 A | * | 8/1965 | Meline et al. | 242/386 |
| 3,272,453 A | * | 9/1966 | Hallock | 242/386 |
| 3,386,682 A | * | 6/1968 | Bajek | 242/386 |
| 3,498,563 A | * | 3/1970 | Palmieri | 242/386 |
| 3,840,713 A | * | 10/1974 | Carpentier | 242/386 |
| 3,889,896 A | * | 6/1975 | O'Hara | 242/386 |
| 4,073,449 A | | 2/1978 | Pilat | |
| 4,467,979 A | | 8/1984 | Koehler | |
| 5,186,411 A | * | 2/1993 | Fanning et al. | 242/405.3 |
| 5,230,480 A | * | 7/1993 | Perry | 242/386 |
| 5,419,508 A | * | 5/1995 | Pierce | 242/386 |
| 6,412,723 B1 | | 7/2002 | Yamaguchi et al. | |

* cited by examiner

*Primary Examiner*—John M. Jillions
(74) *Attorney, Agent, or Firm*—Craig A. Fieschko, Esq.; DeWitt Ross & Stevens S.C.

(57) ABSTRACT

A cable take-up device has a central spool situated between opposing first and second spool end walls, wherein the first spool end wall is rotatable and bears a cable guide thereon which reciprocates along the length of the spool during such rotation. Cable inserted through a cable guide aperture in the cable guide is thereby wound about and along the length of the spool when the first spool end wall is rotated to cause the cable guide to orbit the spool. The first spool end wall preferably bears a feed aperture therein which feeds cable into the cable guide aperture in a direction oriented generally axially with respect to the spool, with the feed aperture being defined within a feed tube which protrudes from the first spool end wall to define a cranking handle. Similarly, the second spool end wall preferably includes a retaining aperture defined therein which admits cable in a generally axial direction, and the second spool end wall preferably also includes a handle which may be grasped by one of a user's hands while the other cranks the feed tube.

30 Claims, 2 Drawing Sheets

DEVICE FOR WINDING / TAKING UP CABLES, RIBBONS, OR OTHER COILABLE STRUCTURES

CROSS-REFERENCE TO RELATED APPLICATIONS

This application claims priority under 35 USC §119(e) to U.S. Provisional Patent Application 60/429,186 filed 26 Nov. 2002, the entirety of which is incorporated by reference herein.

FIELD OF THE INVENTION

This document concerns an invention relating generally to devices for winding cable (wherein the term "cable" should be understood as referring not only to cable, but to rope, cord, tubing, wire, ribbon, or any other elongated flexible matter which is coilable/windable), and more particularly to devices for winding cable wherein one end of the cable may be in a fixed, non-rotatable condition.

BACKGROUND OF THE INVENTION

Many devices require cables (e.g., power cords, hoses, tethering ropes, and the like) for proper operation. As an example, a typical electric appliance receives electric power from a power outlet via an electric power cord. Further, many of these devices have one or both ends of the cable fixed to some anchor in a non-rotatable state; for example, one end of a power cord may be permanently attached to an electric appliance, with the other end of the cord having a plug for attachment to a power outlet. Inconvenience often arises because the cable length is not optimal: again considering the foregoing example of a common electrical appliance, the distance from the appliance to the electrical outlet is usually not fixed and depends upon the specifics of the use of the appliance (i.e., where it is placed in relation to the outlet). Thus, while one generally desires a cable length which is just long enough to reach the outlet, the total cable length is rarely the desired length. Excess cable length can be unsightly, inconvenient, and in some cases dangerous.

Conventional cable spools are sometimes used as a means of storing excess cable length, so that cable can be conveniently taken up or unspooled to allow the desired cable length (e.g., between an appliance and a power outlet). However, as previously noted, many cables have a permanent and non-rotatable fixture at one of their ends. In these instances, in order to wind the cable on a spool, some means is necessary to ensure that the fixed end of the cable does not need to rotate as the cable is being wound on the spool. If this means is not available, the cable may twist and resist winding. Alternatively, if twisting is tolerated while the cable is wound, the twisting of the cable may eventually result in damage to the cable, particularly at its fixed end(s).

Looking to prior fixed end spooling devices, this problem is generally not adequately addressed. Fishing line is a good example of a fixed-end cable application, since one end of the line is usually attached to a fishing reel; however, reel designs generally rely on the ability of the fishing line to twist and flex. In cases where twisting of the cable is unacceptable, the spool and the fixed end of the cable are sometimes connected through a slip coupling, which allows the cable to rotate with the spool without twisting the fixed end of the cable. Such slip couplings are common in garden and air compressor hose reels, where twisting of the hose significantly hinders winding. A slip coupling solves the problem of cable twisting, but it generally requires two free cable ends: the end of the hose is connected to the slip coupling on the hose reel/spool. These arrangements are inconvenient because one must then have a supplemental hose which attaches to the spooling device at the opposite side of the slip coupling to connect the end of the (main) hose to the air/water supply. In some applications, a cable might not be capable of being conveniently detached at one end and connected to the slip coupling, and/or a supplemental cable may be inconvenient. Thus, the slip coupling approach may be unacceptable.

Owing to the foregoing problems, it would be useful to have a cable take-up and storage system which would allow excess cable lengths to be wound up at any location along their lengths, and wherein the cable need not have a detached end in order to allow cable to be wound.

SUMMARY OF THE INVENTION

The invention involves a cable take-up device which is intended to at least partially solve the aforementioned problems. To give the reader a basic understanding of some of the advantageous features of the invention, following is a brief summary of preferred versions of the device. As this is merely a summary, it should be understood that more details regarding the preferred versions may be found in the Detailed Description set forth elsewhere in this document. The claims set forth at the end of this document then define the various versions of the invention in which exclusive rights are secured.

Referring to the accompanying FIGS. 1 and 2 for a brief overview of a preferred version of the invention to enhance the reader's understanding, a cable take-up device 100 includes a spool 102 having opposing first and second spool ends 104 and 106, and a spool axis extending therebetween; a first spool end wall 110 adjacent the first spool end 104, and which rotates about the spool axis; a second spool end wall 112 situated on the second spool end 106 (and preferably being nonrotatably affixed thereon); and a cable guide 114 having a cable guide aperture 116 defined therein through which a cable 200 may be extended, with the cable guide 114 being constrained to rotate with the first spool end wall 110 to orbit the spool 102, and which translates along a path parallel to the spool axis during such rotation. As a result, a cable 200 extending through the cable guide 114 is wound about the spool 102 when the first spool end wall 110 is rotated with respect to the spool axis.

Further features may be provided to assist in orderly winding of a cable 200 about the spool 102. The first spool end wall 110 may include a feed aperture 130 defined therein, and the second spool end wall 112 may include a retaining aperture 138 defined therein, whereby any cable 200 to be wound about the spool 102 has a portion of its length extended through the retaining aperture 138 to extend along the length of the spool 102 and through the cable guide aperture 116, to then extend through the feed aperture 130 in the first spool end wall 110. The retaining aperture 138 assists in holding the cable in a non-interfering position while the cable guide 114 pulls cable 200 through the feed aperture 130 and winds it about the spool 102 as the first spool end wall 110 is rotated (with the feed aperture 130 guiding the cable 200 onto the spool 102 so that it easily feeds onto the spool 102 for winding). Most preferably, the first spool end wall 110 includes a protruding feed tube 132 through which the feed aperture 130 extends, with the feed tube 132 usefully serving as a handle 140 allowing easy cranking of the first spool end wall 110 about the spool 102 (with the cable 200 thereby feeding through the feed tube 132 during cranking). Additionally, so that the cable 200 need not have its end threaded through the feed aperture 130 (and feed tube 132, if present) before winding may occur, it is preferable to have the feed aperture 130 be openable about at least a portion of its perimeter whereby the openable portion of the feed aperture 130 may be opened to place a cable 200 into the feed aperture 130, and then closed to fix the cable 200 within the feed aperture 130. This can be done by forming the feed tube 132 in sections 132A and 132B, as shown in FIG. 2, and these sections 132A and 132B may then be affixed together to define the feed aperture 130 about the cable 200. It is also useful to situate a handle 140 on the second spool end wall 112, preferably protruding from the region of the spool axis, so that this handle 140 may be held by one hand while the user's hand rotates the first spool end wall 110 (as by cranking the feed tube 132, if present).

The cable guide 114 is preferably made to orbit the spool 102 and translate along its length by riding along a first track 118 which extends from the first spool end wall 110 toward the second spool end 106, wherein the first track 118 preferably engages and drives the cable guide 114 along the first track 118 when the first spool end wall 110 rotates. This may be done, for example, by forming the first track 118 as a helical screw/worm drive which engages the cable guide 114, and wherein the first track 118 rotates relative to the first spool end wall 110 when the first spool end wall 110 is rotated. The first track 118 can be made to rotate relative to the first spool end wall 110 by coupling a rotating drive 122 (e.g., gearing, belts/pulleys, chain drives, or similar arrangements) between the spool 102 and the first track 118 to rotate the track relative to the first spool end wall 110 when the first spool end wall 110 is rotated relative to the spool 102. It is also useful to provide a second track 124 extending adjacent the first track 118 from the first spool end wall 110 toward the second spool end 106, wherein the cable guide 114 also translates along the second track 124 during such rotation. By riding along at least two tracks in this manner, the cable guide 114 will maintain the same orientation with respect to the spool axis as it orbits the spool axis, thereby assisting in preventing cable tangling. For durability, a track yoke 128 preferably extends between the tracks at their ends opposite the first spool end wall 110.

Further advantages, features, and objects of the invention will be apparent from the following detailed description of the invention in conjunction with the associated drawings.

DETAILED DESCRIPTION OF PREFERRED VERSIONS OF THE INVENTION

Figure 1:
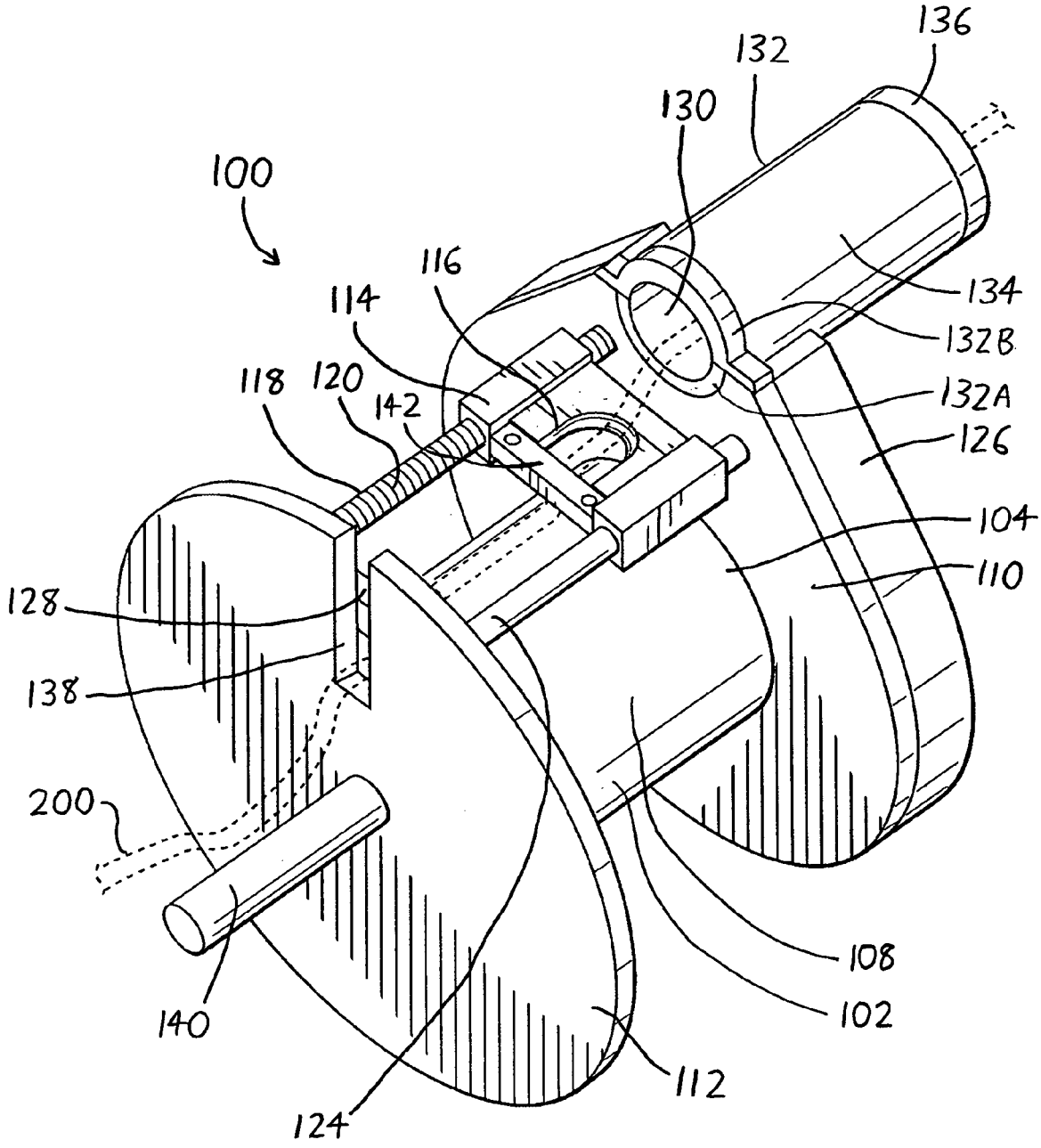
FIG. 1 is a perspective view of an exemplary version of the invention, showing a cable take-up device 100 with a length of cable 200 (shown in phantom) in a ready-to-wind state.
Figure 2:
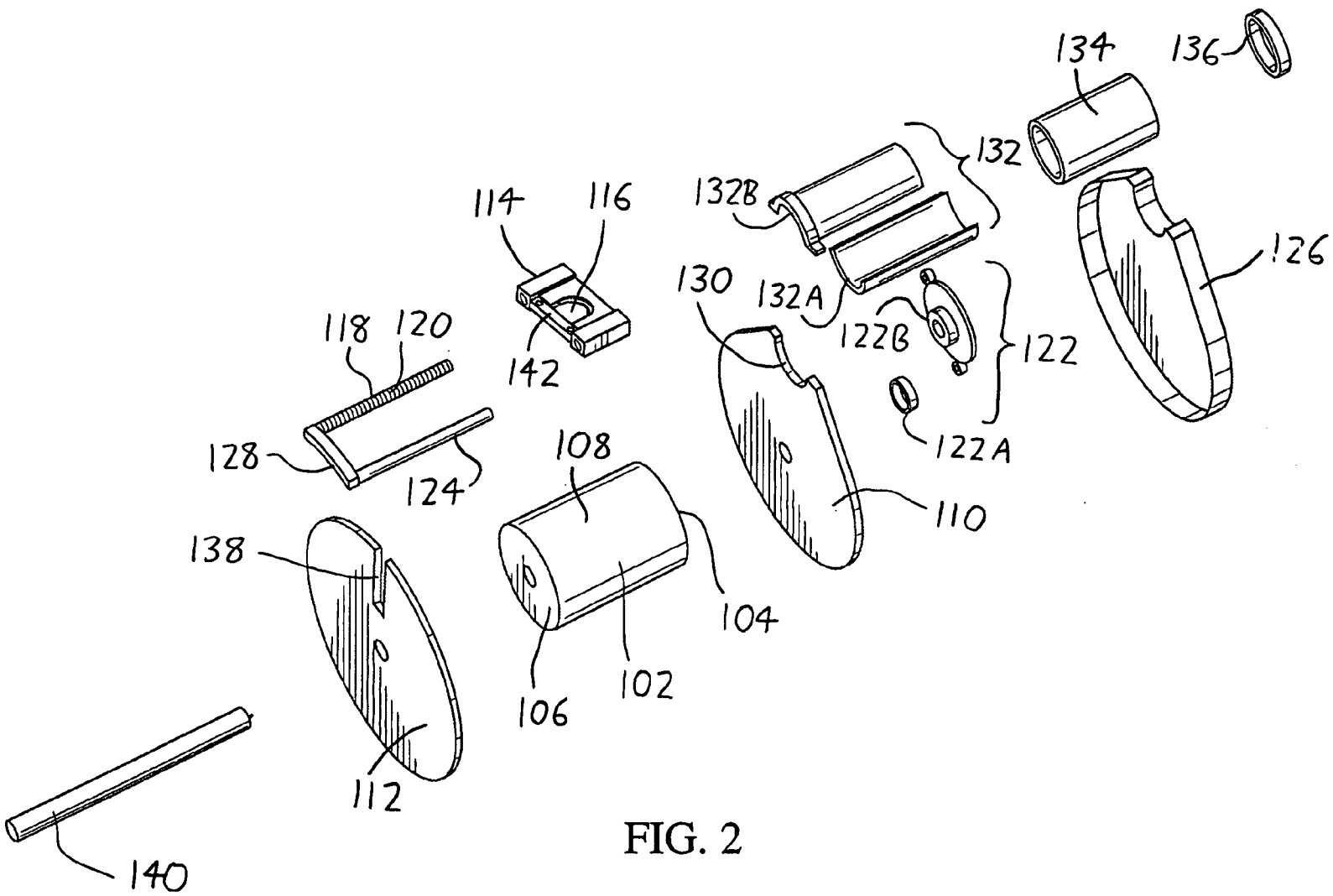
FIG. 2 is an exploded perspective view of the cable take-up device 100 of FIG. 1.

An exemplary version of the invention is illustrated in the accompanying FIGS. 1 and 2, wherein a cable take-up device is designated generally by the reference numeral 100. The device 100 includes a spool 102 having a first spool end 104 and an opposing second spool end 106 (shown in FIG. 2 but not visible in FIG. 1), with a spool outer circumference 108 extending therebetween about which a length of cable (illustrated in phantom at 200) is to be wound. The spool outer circumference 108 preferably has a circular cross-section centered about a central spool axis (not shown), though the spool outer circumference 108 might potentially have another shape, as will be discussed below.

A first spool end wall 110 is situated at the first spool end 104, and it preferably has a diameter sized to radially extend outwardly from the spool outer circumference 108 in the manner shown in FIG. 1, such that any cable 200 wound about the spool outer circumference 108 cannot easily slip over the first spool end wall 110 and off of the spool 102. Similarly, a second spool end wall 112 is provided at the second spool end 106, and is also preferably sized to radially extend from the spool outer circumference 108 to assist in retaining wound cable 200 on the spool outer circumference 108.

A cable guide 114 is then provided, and includes a cable guide aperture 116 defined therein through which the cable 200 may be fit during winding. The cable guide 114 is constrained to orbit the spool outer circumference 108, and at the same time translate along a path parallel to the spool axis as it orbits, so that a cable 200 extending through the cable guide aperture 116 may be wound about the spool outer circumference 108 in adjacent rows (as opposed to the wound cable being "stacked" in one region on the spool outer circumference 108, as would occur if the cable guide 114 did not translate). This motion of the cable guide 114 is preferably achieved as follows. The first spool end wall 110 is preferably rotatably mounted with respect to the second spool end wall 112, most preferably by rotatably mounting the first spool end wall 110 on the first spool end 104 so that it may rotate with respect to the spool 102 and the second spool end wall 112 (which is preferably nonrotatably affixed to the second spool end 106). A first track 118 then extends from the first spool end wall 110 toward the second spool end wall 112 along a path parallel to the spool axis, with the cable guide 114 riding on the first track 118. The device 100 is provided with some means for driving the cable guide 114 along the first track 118 such that when the first spool end wall 110 is rotated in relation to the second spool end wall 112, the cable guide 114 is driven along at least a portion of the length of the first track 118. Different means for driving the cable guide 114 along the first track 118 are possible, with a simple arrangement being to provide threading 120 on at least a portion of the first track 118 to engage the cable guide 114, and then rotating the first track 118 with respect to the first spool end wall 110 as the wall 110 rotates about the spool axis. As best shown in the exploded view of FIG. 2, this can be done by situating a rotating drive 122 on the exterior of the first spool end wall 110 (on its face opposite the face abutting the first spool end 104), with the rotating drive 122 being coupled between the spool 102 and the first track 118 such that when the first spool end wall 110 is rotated with respect to the spool 102, the first track 118 is rotated with respect to the first spool end wall 110. As depicted in FIG. 2, the rotating drive 122 includes a series of bushings 122A and gears 122B, but a variety of other rotating drives 122 are also possible, e.g., belt/pulley arrangements, chain and sprocket arrangements, or other arrangements for transmitting rotary motion along the first spool end wall 110 between the spool axis and the first track 118. A casing 126 may be mounted on the first spool end wall 110 to enclose the rotating drive 122 and prevent the cable 200 or other matter from interfering with the rotating drive 122.

Thus, when the first spool end wall 110 is rotated with respect to the spool 102 and the second spool end wall 112, the first track 118 orbits the spool outer circumference 108 and the cable guide 114 is translated along the first track 118. A second track 124 spaced from the first track 118 is then usefully provided to extend from the first spool end wall 110 toward the second spool end wall 112 in a direction generally parallel to the spool axis. As the cable guide 114 is driven along the first track 118, it may simply slidably translate along the second track 124. Alternatively, the second track 124 might also bear some means (such as threading) for driving the cable guide 114 along the second track 124, and it might be actuated similarly to the first track 118. The second track 124 assists in restraining the cable guide 114 so that it will travel as desired along the first track 118, with the cable guide 114 preferably always being oriented to have the cable guide aperture 116 facing toward the spool outer circumference 108 as the first and second tracks 118 and 120 (and the cable guide 114) orbit the spool outer circumference 108.

It is notable that the first and second tracks 118 and 124 do not extend from the first spool end wall 110 to connect with the second spool end wall 112, since such an arrangement would prevent the first spool end wall 110 from rotating with respect to the second spool end wall 112. Rather, the first and second tracks 118 and 124 extend from the first spool end wall 110 to terminate prior to reaching the second spool end wall 112. For sake of durability, it is useful to provide a track yoke 128 which extends between and supports the first and second spool end walls 110 and 112 (with this track yoke 128 only being partially shown in FIG. 1, and being more fully illustrated in FIG. 2). The track yoke 128 has the first track 118 rotatably journalled therein, whereas it may be rigidly affixed to the second track 124, provided the second track 124 does not also rotate.

By the use of the foregoing arrangement, when a cable 200 is extended through the cable guide aperture 116 and the first spool end wall 110 is rotated with respect to the second spool end wall 112, the cable guide 114 will pull the cable about and along the length of the spool outer circumference 108, thereby winding the cable about the spool outer circumference 108.

Further features are then useful to help situate lengths of cable 200 which are spaced away from the cable guide 114 in an orderly location where they will not interfere with the cable winding action of the device 100. First, since interference from the cable during winding may be substantially reduced if the cable is fed onto the spool 102 from directions oriented axially with respect to the spool 102 rather than radially, it is useful to define a feed aperture 130 on the first spool end wall 110, most preferably near the axis along which the cable guide aperture 116 translates along the spool 102, so that cable 200 may be axially fed through the feed aperture 130 to the cable guide aperture 116 in the cable guide 114. Since it would be inconvenient if the user needed to thread an end of the cable 200 through the feed aperture 130 before winding (since this would often require that the user thread a substantial length of cable 200 through the feed aperture 130), the feed aperture 130 is preferably made openable about a portion of its perimeter whereby the feed aperture 130 may be opened to allow placement of the cable 200 within the feed aperture 130, and then closed to fix the cable 200 within the feed aperture 130. One way of achieving this arrangement can be seen with respect to FIGS. 1 and 2, wherein the feed aperture 130 is usefully defined within a feed tube 132 which protrudes from the first spool end wall 110 to better axially orient the cable 200 prior to feeding it to the cable guide 114, and which also usefully serves as a handle allowing easy manual rotation of the first spool end wall 110 with respect to the spool 102. The feed tube 132 is split along its axis into a pair of feed tube sections 132A and 132B (see particularly FIG. 2), wherein the feed tube section 132A is fixed to the first spool end wall 110, and the other feed tube section 132B is removable (and which might connect to the fixed feed tube section 132A via snap-fitting or the like). Such an arrangement allows easy placement of the cable 200 within the feed aperture 130 by simply removing the removable feed tube section 132B, placing the cable 200 in the fixed feed tube section 132A, and then replacing the removable feed tube section 132B to define the handle/feed tube 132 about the feed aperture 130 on the first spool end wall 110. FIG. 2 illustrates a particularly preferred arrangement wherein a gripping sleeve 134 complimentarily and rotatably fits over the feed tube sections 132A and 132B, and which may then be retained thereon via a retaining ring 136. The retaining ring 136 may removably snap onto or otherwise connect to the ends of the feed tube sections 132A and 132B to rotatably retain the gripping sleeve 134 between the retaining ring 136 and the first spool end wall 110. While the gripping sleeve 134 (and thus the retaining ring 136) are not necessary, the gripping sleeve 134 provides a rotating grip for greater comfort when a user grasps it and cranks the handle/feed tube 132 to rotate the first spool end wall 110. When the first spool end wall 110 is rotated in this manner, any cable extending through the feed aperture 130 and cable guide aperture 116 will be pulled through the feed aperture 130 and wound about the spool outer circumference 108 by the cable guide 114.

Similarly, at the second spool end wall 112, a retaining aperture 138 is preferably defined therein to allow the cable 200 to extend axially from the exterior of the device 100 to a location adjacent the spool outer circumference 108, so that the cable length outside the second spool end wall 112 will not interfere with cable winding operations. Note that as the handle/feed tube 132 is cranked to rotate the first spool end wall 110 with respect to the spool 102 and the second spool end wall 112, the cable 200 will primarily be drawn onto the spool 102 through the (rotating) first spool end wall 110 as opposed to the second spool end wall 112, and thus minimal or no cable 200 is drawn in through the retaining aperture 138 (especially after the cable 200 has begun to loop about the spool outer circumference 108 by one or more revolutions). To further assist in ease of winding, it is useful to provide a handle 140 on the second spool end wall 112 so that one of the user's hands may grasp the handle 140 while the other cranks the other handle/feed tube 132. The handle 140 may take a variety of forms, such as the rod-like handle 140 extending from the spool axis (as depicted in FIG. 1), or could take other forms, such as a gripping member extending parallel to the outer surface of the second spool end wall 112. The rod-like handle 140 extends through (and it is affixed to) the second spool end wall 112 and spool 102, and the first spool end wall 110 is rotatably mounted thereon to allow its rotation about the spool axis.

It is understood that the various preferred versions of the invention are shown and described above to illustrate different possible features of the invention and the varying ways in which these features may be combined. Apart from combining the different features of the foregoing versions in varying ways, other modifications are also considered to be within the scope of the invention. Following is an exemplary list of such modifications.

First, the spool 102 might have an outer circumference 108 which is not cylindrical. For example, the spool 102 might have an oval or plate-like cross-section. Further, the spool 102 need not have a uniform diameter over its length between the spool end walls 110 and 112. However, whatever form the spool 102 takes, it must be sized such that the cable guide 114 may orbit the spool outer circumference 108 without interference (from the spool outer circumference 108 and/or the cable 200 wound thereon). In similar respect, note that the feed tube 132, while termed a "tube," need not have a circular cross-sectional shape (nor need the feed aperture 130 therein have such a shape). In short, it should be kept in mind that the device 100 shown and described previously is merely one example of a form the invention might take, and it should be understood that the various components of the device 100 may have configurations substantially different from those shown and described.

Second, while it is preferred that the first spool end wall 110 be rotatably affixed to the spool 102 and second spool end wall 112, it is instead possible to have the first spool end wall 110 nonrotatably attached to the spool 102, with the second spool end wall 112 then being rotatably attached to the spool 102. The device 100 is used in the same manner, save that the spool 102 rotates along with the first spool end wall 110 on the second spool end wall 112 when the first spool end wall 110 is cranked.

Third, as suggested previously, the cable guide 114 might be driven by more than one of the tracks 118 and 124, and/or yet further tracks might be added along which the cable guide 114 travels. Additionally, other arrangements might be used to drive the cable guide 114 along the first and second tracks 118 and 124 apart from defining the first track 118 as a threaded member. As an example, the first track 118 might have one or more cam members protruding from its circumference, and these might interact with corresponding following surfaces within the cable guide 114 to drive the cable guide 114 along the first track 118. Ball screws or other mechanisms which translate rotary to linear motion could alternatively or additionally used instead. Further, the track(s) 118 and/or 124, cable guide 114, and rotating drive 122 may be configured to drive the cable guide 114 in one direction on the tracks 118 and 124 with one of clockwise or counterclockwise rotation of the first spool end wall 110, or these can be configured to allow the cable guide 114 to reverse direction on the tracks 118 and 124 with one of clockwise or counterclockwise rotation of the first spool end wall 110, whereby continued cranking of the first spool end wall 110 causes the cable guide 114 to reciprocate on the tracks 118 and 124.

Fourth, the feed aperture 130, retaining aperture 138, and cable guide aperture 116 need not be defined as through-holes in their respective structures (i.e., in the first spool end wall 110, second spool end wall 112, and cable guide 114), and they may instead be defined as slots (as illustrated by the retaining aperture 138), and/or may be at least partially bound by movable structures which allow the apertures to be opened/closed about at least a portion of their circumference (as illustrated by the feed aperture 130). To illustrate, while the cable guide 114 is generally intended to have an enclosed cable guide aperture 116 through which a user simply threads one end of the cable 200 before starting winding, the cable guide might have a removable section—such as the section 142—which might unsnap from the cable guide 114 to allow placement of the cable 200 within the cable guide aperture 116, with the aperture 116 then being closed by replacing the section 142. Alternatively, the section 142 might be formed as a hinged latch wherein one of its ends might be released from the cable guide 114, the section 142 might be swung outwardly from the cable guide aperture 116 to allow placement of the cable 200 therein, and the section 142 might then be swung back in and reaffixed to the cable guide 114 to enclose the cable guide aperture 116. In similar respect, note that the track yoke 128 may be spaced only slightly from the second spool end wall 112 in such a location that it rests across the plane defined by the illustrated slot-like retaining aperture 138, and the track yoke 128 might have an open cavity at its end into which the second track 124 is snap-fit, whereby the track yoke 128 can be unsnapped from the second track 124 and swung about the first track 118 to which the track yoke 128 is journalled to allow a cable 200 to be easily inserted into the retaining aperture 138 and extended along the spool outer circumference 108. The cable 200 may then be effectively enclosed within the retaining aperture 138 by swinging the track yoke 128 back to engage the second track 124, so that the track yoke 128 forms a barrier preventing easy escape of the cable 200 from the retaining aperture 138.

Fifth, it is also possible to define one or more of the foregoing apertures as an open-ended slot having a nonlinear shape (e.g., a spiral shape or the like), wherein the cable 200 may be readily inserted into the aperture/slot to rest against its end, but the slot walls curving about the cable will serve to substantially bound the cable 200 within the aperture and prevent it from readily falling out.

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. A cable take-up device comprising:

a. a spool having opposing first and second spool ends, and a spool axis extending therebetween surrounded by an outer spool circumference;

b. a rotatable spool end wall rotatably affixed to the first spool end;

c. a cable guide which:

(1) rotates with the rotatable spool end wall to orbit the outer spool circumference, and (2) translates along a path parallel to the spool axis during such rotation, the cable guide having a cable guide aperture defined thereon through which a cable may be extended, whereby rotating the rotatable spool end wall with respect to the spool orbits the cable guide about the spool while translating the cable guide parallel to the spool axis, thereby winding any cable extending through the cable guide aperture about the outer spool circumference.

2. The cable take-up device of claim 1 wherein the rotatable spool end wall includes a feed aperture defined therein, and wherein at least a portion of the rotatable spool end wall which defines the perimeter of the feed aperture is openable, whereby the openable portion may be opened to place a cable into the feed aperture and closed to fix the cable within the feed aperture.

3. The cable take-up device of claim 1 wherein:

a. the rotatable spool end wall includes a feed tube protruding therefrom, with the rotatable spool end wall being situated between the spool and the feed tube; and b. a feed aperture extends through the feed tube and the rotatable spool end wall.

4. The cable take-up device of claim 3 wherein the feed tube is openable along the length of the feed aperture, whereby the feed tube may be opened to place a cable into the feed aperture and closed to fix the cable within the feed aperture.

5. The cable take-up device of claim 1 further comprising a fixed spool end wall nonrotatably fixed to the second spool end, the fixed spool end wall having a retaining aperture defined therein.

6. The cable take-up device of claim 1 further comprising a fixed spool end wall nonrotatably fixed to the second spool end, the fixed spool end wall having a handle protruding therefrom, with the fixed spool end wall being situated between the spool and the handle.

7. The cable take-up device of claim 1:

a. further comprising a second spool end wall situated at the second spool end, the second spool end wall including:
   (1) a retaining aperture defined therein, and
   (2) a handle protruding therefrom, with the second spool end wall being situated between the spool and the handle;

b. and wherein the rotatable spool end wall includes:
   (1) a feed tube protruding therefrom, with the rotatable spool end wall being situated between the spool and the feed tube, and
   (2) a feed aperture defined therein, with the feed aperture extending through the feed tube.

8. The cable take-up device of claim 7 wherein the second spool end wall is nonrotatably affixed to the spool.

9. The cable take-up device of claim 7 wherein the feed tube is openable along the length of the feed aperture, whereby the feed tube may be opened to place a cable into the feed aperture and closed to fix the cable within the feed aperture.

10. The cable take-up device of claim 7 further comprising a track extending from the rotatable spool end wall toward the second spool end, whereby the track rotates with the rotatable spool end wall to orbit the outer spool circumference, and wherein the cable guide translates along the track during such rotation.

11. The cable take-up device of claim 10 wherein the track rotates relative to the rotatable spool end wall when the rotatable spool end wall is rotated relative to the spool, and wherein rotation of the track relative to the rotatable spool end wall causes the cable guide to translate along the track.

12. The cable take-up device of claim 1 further comprising a track extending from the rotatable spool end wall toward the second spool end, whereby the track rotates with the rotatable spool end wall to orbit the outer spool circumference, and wherein the cable guide translates along the track during such rotation.

13. The cable take-up device of claim 12 wherein the track rotates relative to the rotatable spool end wall when the rotatable spool end wall is rotated relative to the spool.

14. The cable take-up device of claim 13:

a. further comprising a second spool end wall situated at the second spool end, the second spool end wall including:
   (1) a retaining aperture defined therein, and
   (2) a handle protruding therefrom, with the second spool end wall being situated between the spool and the handle;

b. and wherein the rotatable spool end wall includes:
   (1) a feed tube protruding therefrom, with the rotatable spool end wall being situated between the spool and the feed tube, and
   (2) a feed aperture defined therein, with the feed aperture extending through the feed tube.

15. The cable take-up device of claim 12 further comprising a rotating drive provided on the rotatable spool end wall, the rotating drive being coupled between the spool and the track to rotate the track relative to the rotatable spool end wall when the rotatable spool end wall is rotated relative to the spool.

16. The cable take-up device of claim 12 further comprising a second track extending from the rotatable spool end wall toward the second spool end, whereby the second track rotates with the rotatable spool end wall to orbit the outer spool circumference, and wherein the cable guide translates along the second track during such rotation.

17. A cable take-up device comprising:

a. a spool having opposing first and second spool ends, and a spool axis extending therebetween surrounded by an outer spool circumference;

b. a rotatable spool end wall rotatably mounted on the first spool end and including a feed aperture defined thereon;

c. a track extending from the rotatable spool end wall toward the second spool end;

d. a cable guide having a cable guide aperture defined therein, the cable guide being translatable on the track; wherein:
   (1) a cable may be extended through the cable guide aperture and the feed aperture; and
   (2) rotating the rotatable spool end wall with respect to the spool orbits the cable guide about the spool while translating the cable guide along the track, thereby winding the cable about the outer spool circumference.

18. The cable take-up device of claim 17 wherein at least a portion of the track rotates relative to the rotatable spool end wall when the rotatable spool end wall is rotated with respect to the spool, and wherein such rotation of at least a portion of the track translates the cable guide along the track.

19. The cable take-up device of claim 17:

a. wherein at least a portion of the track rotates relative to the rotatable spool end wall when the rotatable spool end wall is rotated with respect to the spool; and b. wherein the cable take-up device further comprises a second track extending from the rotatable spool end wall toward the second spool end, and wherein:
   (1) when the rotatable spool end wall is rotated with respect to the spool, the second track travels with the rotatable spool end wall to orbit the outer spool circumference, and
   (2) the cable guide translates along the second track during such travel.

20. The cable take-up device of claim 17 further comprising a second spool end wall situated at the second spool end, the second spool end wall including:

a. a retaining aperture defined therein, and b. a handle protruding therefrom, with the second spool end wall being situated between the spool and the handle.

21. The cable take-up device of claim 20 wherein the second spool end wall is nonrotatably affixed to the spool.

22. The cable take-up device of claim 20 wherein at least a portion of the perimeter of the feed aperture is openable, whereby the openable portion may be opened to place a cable into the feed aperture and closed to fix the cable within the feed aperture.

23. The cable take-up device of claim 22 wherein:

a. the rotatable spool end wall includes a feed tube protruding therefrom, with the rotatable spool end wall being situated between the spool and the feed tube, and b. the feed aperture extends through the rotatable spool end wall and feed tube.

24. The cable take-up device of claim 17 wherein:

a. the rotatable spool end wall includes a feed tube protruding therefrom, with the rotatable spool end wall being situated between the spool and the feed tube, and b. the feed aperture extends through the rotatable spool end wall and feed tube.

25. A cable take-up device comprising:

a. a spool having opposing first and second spool ends, and a spool axis extending therebetween surrounded by an outer spool circumference;

b. a fixed spool end wall situated on the second spool end and having a retaining aperture defined therein;

c. a rotatable spool end wall situated on the first spool end, the rotatable spool end wall being rotatable with respect to the fixed spool end wall and including a feed aperture defined thereon;

d. a track affixed to the rotatable spool end wall and extending toward the fixed spool end wall;

e. a cable guide having a cable guide aperture defined therein, the cable guide translating on the track when the rotatable spool end wall is rotated with respect to the fixed spool end wall.

26. The cable take-up device of claim 25 wherein:

a. the rotatable spool end wall is rotatably affixed to the spool, and b. the fixed spool end wall is nonrotatably affixed to the spool.

27. The cable take-up device of claim 25 wherein:

a. the rotatable spool end wall includes a feed tube protruding therefrom, with the feed aperture extending through the feed tube and the rotatable spool end wall; and b. the fixed spool end wall includes a handle protruding therefrom, with the fixed spool end wall being situated between the spool and the handle.

28. The cable take-up device of claim 25:

a. wherein at least a portion of the track rotates relative to the rotatable spool end wall when the rotatable spool end wall is rotated with respect to the fixed spool end wall, thereby translating the cable guide on the track;

b. further comprising a second track along which the cable guide translates when the rotatable spool end wall is rotated with respect to the fixed spool end wall; and c. further comprising a track yoke extending between the tracks, the tracks extending between the track yoke and the rotatable spool end wall.

29. The cable take-up device of claim 28 wherein:

a. the rotatable spool end wall includes a feed tube protruding therefrom, with the rotatable spool end wall being situated between the spool and the feed tube; and b. the feed aperture extends through the feed tube and the rotatable spool end wall.

30. The cable take-up device of claim 29 further comprising a handle protruding from the fixed spool end wall, with the fixed spool end wall being situated between the spool and the handle.

* * * * *